US006371581B1

(12) United States Patent
Ring et al.

(10) Patent No.: US 6,371,581 B1
(45) Date of Patent: Apr. 16, 2002

(54) VENDING MACHINE WITH QUICK RELEASE DOOR

(75) Inventors: Michael D. Ring, Charles Town; David A. Yates, Falling Waters, both of WV (US); Thomas S. Paczkowski, Wildwood, MO (US)

(73) Assignee: Royla Vendors, Inc., Kearneysville, WV (US)

( * ) Notice: Subject to any disclaimer, the term of this patent is extended or adjusted under 35 U.S.C. 154(b) by 0 days.

(21) Appl. No.: 09/543,362

(22) Filed: Apr. 5, 2000

(51) Int. Cl.[7] ..... A47F 3/00

(52) U.S. Cl. ..... 312/138.1; 312/298

(58) Field of Search ..... 312/291, 292, 312/293.1, 293.2, 293.3, 298, 300, 301, 326, 329, 35, 36, 138.1, 405; 49/257, 260, 188, 169, 383, 463; 16/270, 271, 382

(56) References Cited

U.S. PATENT DOCUMENTS 42,764 A * 5/1864 Harrington
845,503 A 2/1907 Anderson
853,384 A 5/1907 Tolnes
1,012,606 A * 12/1911 Davis
1,564,668 A * 12/1925 Hageman
2,385,169 A * 9/1945 Stone
2,845,320 A 7/1958 Saunders et al. ..... 312/204
3,266,859 A 8/1966 Champlin ..... 312/323
3,270,462 A * 9/1966 Obadal et al.
3,478,383 A * 11/1969 Brooks
3,680,937 A * 8/1972 Steeley ..... 49/383 X
4,099,293 A * 7/1978 Pittasch
4,620,392 A * 11/1986 Karpers et al.
4,744,175 A * 5/1988 Albright et al. ..... 312/138.1 X
5,143,430 A * 9/1992 Craven et al. ..... 312/291
5,193,308 A 3/1993 Davidian ..... 49/381
5,215,367 A 6/1993 Montuoro ..... 312/401
5,265,954 A * 11/1993 Keil
5,372,416 A * 12/1994 Shapley et al. ..... 312/138.1
5,666,764 A 9/1997 Beatty et al. ..... 49/397
5,806,144 A * 9/1998 Fries
5,870,801 A * 2/1999 Kim ..... 16/382
5,884,366 A * 3/1999 Jeong ..... 16/382 X
5,960,518 A * 10/1999 Jeong ..... 16/270

* cited by examiner

*Primary Examiner*—James O. Hansen
(74) *Attorney, Agent, or Firm*—Jacobson Holman, PLLC

(57) ABSTRACT

A vending machine having a vandal panel and main door that can be easily removed through upper and lower hinge assemblies without use of conventional fasteners and tools is provided. As a result, the depth of the vending machine is reduced.

23 Claims, 14 Drawing Sheets

VENDING MACHINE WITH QUICK RELEASE DOOR

BACKGROUND OF THE INVENTION

1. Field of the Invention

The present invention is directed to a vending machine having a main door that is easily removable from the vending machine cabinet. More specifically, the invention is directed to a vending machine in which the main door can be removed without tools in order to minimize cabinet depth.

2. Related Art

In a conventional vending machine, the vandal panel is permanently attached to, and protrudes past the front of the cabinet. The lower hinge of the main door and the door lifter bracket rest on a base plate, which also extends past the front of the cabinet. Both of these features effectively increase cabinet depth, making it difficult, if not impossible, to locate the vending machine in a narrow passageway. Also, in a conventional vending machine, the upper hinge of the main door is held in place by five fasteners, and the inner door is mounted to the main door by two self-tapping screws. Removal of the main door from the cabinet requires removal of all five main door fasteners; and removal of the inner door from the main door requires removal of the self-tapping screws. Conversely, assembly of the main door to the cabinet and the inner door to the main door require re-installation of the fasteners and the self-tapping screws, respectively. Neither the fasteners nor the self-tapping screws can be removed or re-installed without the use of tools.

Although there are many examples of mechanisms designed to facilitate the installation and removal of doors and the like from cabinets, refrigerators, other enclosures, and support surfaces (see, for example, U.S. Pat. No. 5,806,144 to Fries; U.S. Pat. No. 5,265,954 to Keil; U.S. Pat. No. 5,193,308 to Davidian; U.S. Pat. No. 4,620,392 to Kerpers et al.; U.S. Pat. No. 4,099,293 to Pittasch; U.S. Pat. No. 3,478,383 to Brooks; U.S. Pat. No. 3,270,462 to Obadal et al.; U.S. Pat. No. 2,385,169 to Stone; U.S. Pat. No. 1,564,668 to Hageman; U.S. Pat. No. 1,012,606 to Davis; and Pat. No. 42,764 to Harrington), the prior art does not provide any such mechanism adapted to permit the installation and removal of a main door of a vending machine quickly and without tools. It is to the solution of these, and other problems, to which the present invention is directed.

SUMMARY OF THE INVENTION

It is therefore a primary object of the present invention to provide a vending machine in which the vandal panel and the main door can be easily removed, particularly without the need to remove fasteners or use tools to effect removal of the vandal panel and the main door.

It is another object of the present invention to provide a vending machine in which the depth of the main door lower hinge is reduced.

It is still another object of the present invention to provide a vending machine in which the inner door can easily be removed from the main door.

These and other objects of the invention are achieved through provision of a vending machine having a selectively removable main door that is assembled to the vending machine cabinet by upper and lower hinge assemblies that omit conventional fasteners that require tools for their installation and removal.

The upper hinge assembly includes a hinge plate that is selectively engageable with the main door and an upper hinge latch mechanism that is installed in the interior of the cabinet and that selectively mounts the hinge plate to the cabinet. The upper hinge latch mechanism includes a spring-biased plunger that is normally biased to engage the hinge plate. The lower hinge assembly includes a hinge base that is also selectively engageable with the main door and a lower hinge latch mechanism that is installed in the interior of the cabinet and that selectively retains the hinge base in the cabinet. The lower hinge latch mechanism includes a spring-biased pin that is normally biased to engage the hinge plate.

In one aspect of the invention, an inner door is provided over the inner face of the main door. An inner door hinge assembly hinges the inner door to the hinged side of the interior face of the main door along one side thereof and permits selective removal of the inner door from the main door without the use of tools or the removal of fasteners.

In another aspect of the invention, a vandal panel is positioned to cover the facing edges of the hinged sides of the main door and the cabinet when the main door is in the closed position. The vandal panel has upper and lower ends engaging the hinge plate and the lower hinge assembly, respectively, and is removable therefrom without the use of tools or the removal of fasteners.

In still another aspect of the invention, a door lifter mechanism is provided for supporting the weight of the main door while the main door is in the closed position, and for compensating for any sagging of the main door that may occur. The door lifter mechanism comprises a door lifter extending outwardly from the inner face of the main door and a door lifter bracket positioned in the cabinet to receive the door lifter bracket when the main door is in the closed position.

Other objects, features and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
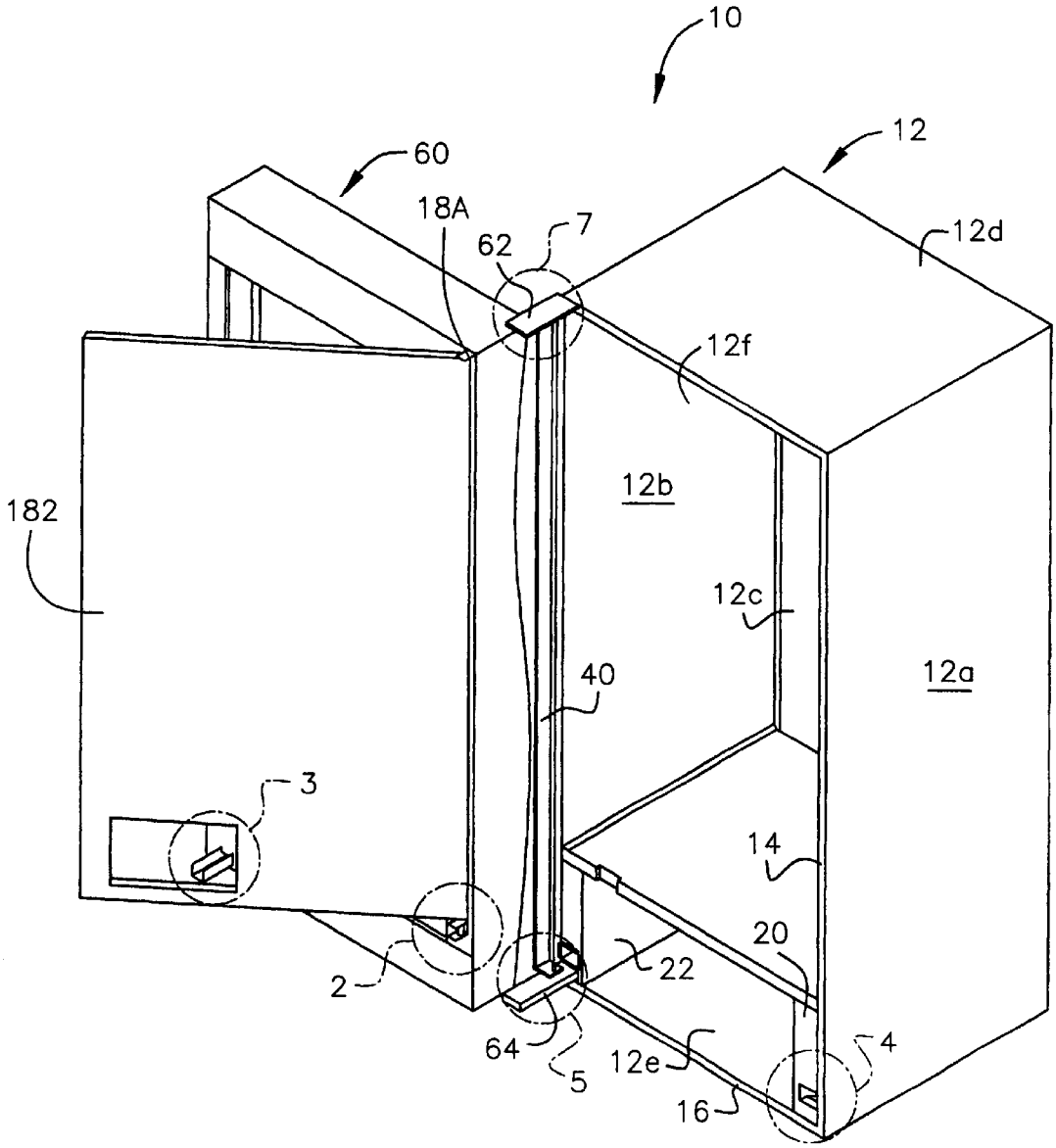
FIG. 1 is a perspective view of a vending machine incorporating a removable door in accordance with the present invention.
Figure 2:
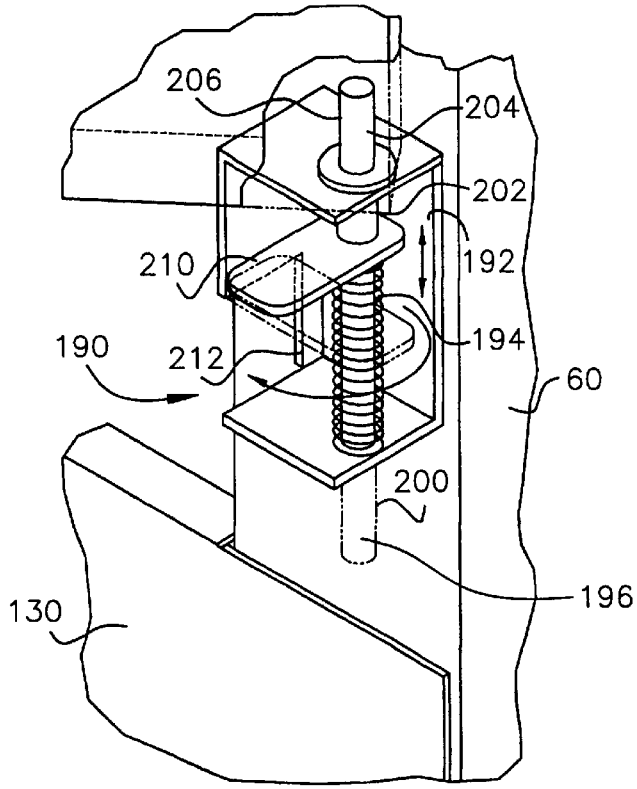
FIG. 2 is an enlarged view of the area designated by the dashed circle denoted FIG. 2 in FIG. 1.
Figure 3:
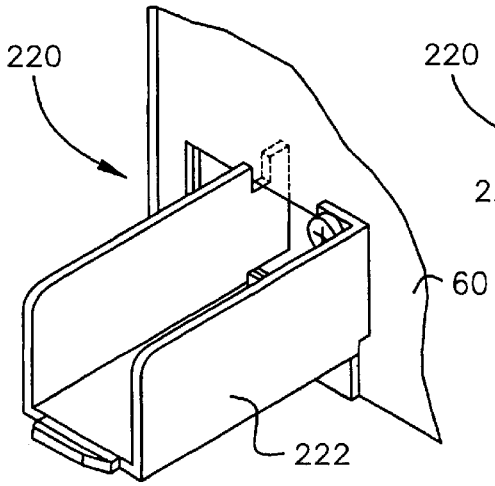
FIG. 3 is an enlarged view of the area designated by the dashed circle denoted FIG. 3 in FIG. 1.
Figure 4:
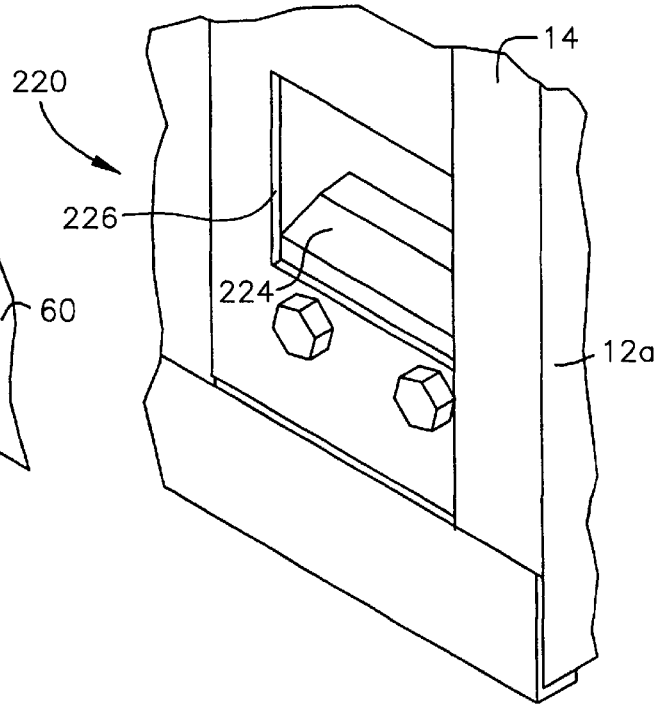
FIG. 4 is an enlarged view of the area designated by the dashed circle denoted FIG. 4 in FIG. 1.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Referring now to FIG. 1, there is shown a vending machine 10 in accordance with the present invention. The vending machine 10 includes a the cabinet 12 having opposed left and right side walls 12*a* and 12*b*, a back wall 12*c*, top and bottom walls 12*d* and 12*e*, and an open front face 12*f*. The open front face 12*f* is bordered by a flange 14 along the side and top walls 12*a*, 12*b*, and 12*d*, and by a base plate 16 along the bottom wall 12*e*. Left and right panels 20 and 22 enclose the bottom portions of the left and right side walls 12*a* and 12*b* from the front face 12*f* to the back wall 12*c* of the cabinet 12, for a purpose to be described hereinafter. The front faces of the left and right panels 20 and 22 are flush with the front face 12*f* of the cabinet 12.

A vandal panel cover 30 is permanently attached along its rear edge (FIG. 7A) to the exterior of the right side wall 12*b* adjacent the front face 12*f*, for example by fasteners such as rivets. The front edge of the vandal panel cover 30 lies in a different plane from the rear edge, and is offset from the right side wall 12*b* so as to define a pocket 36 (FIGS. 7 and 7A) between the vandal panel cover 30 and the right side wall 12*b* adjacent the front face 12*f*, for receiving a vandal panel 40. The vandal panel cover 30 provides rigidity to the vandal panel 40.

Figure 5:
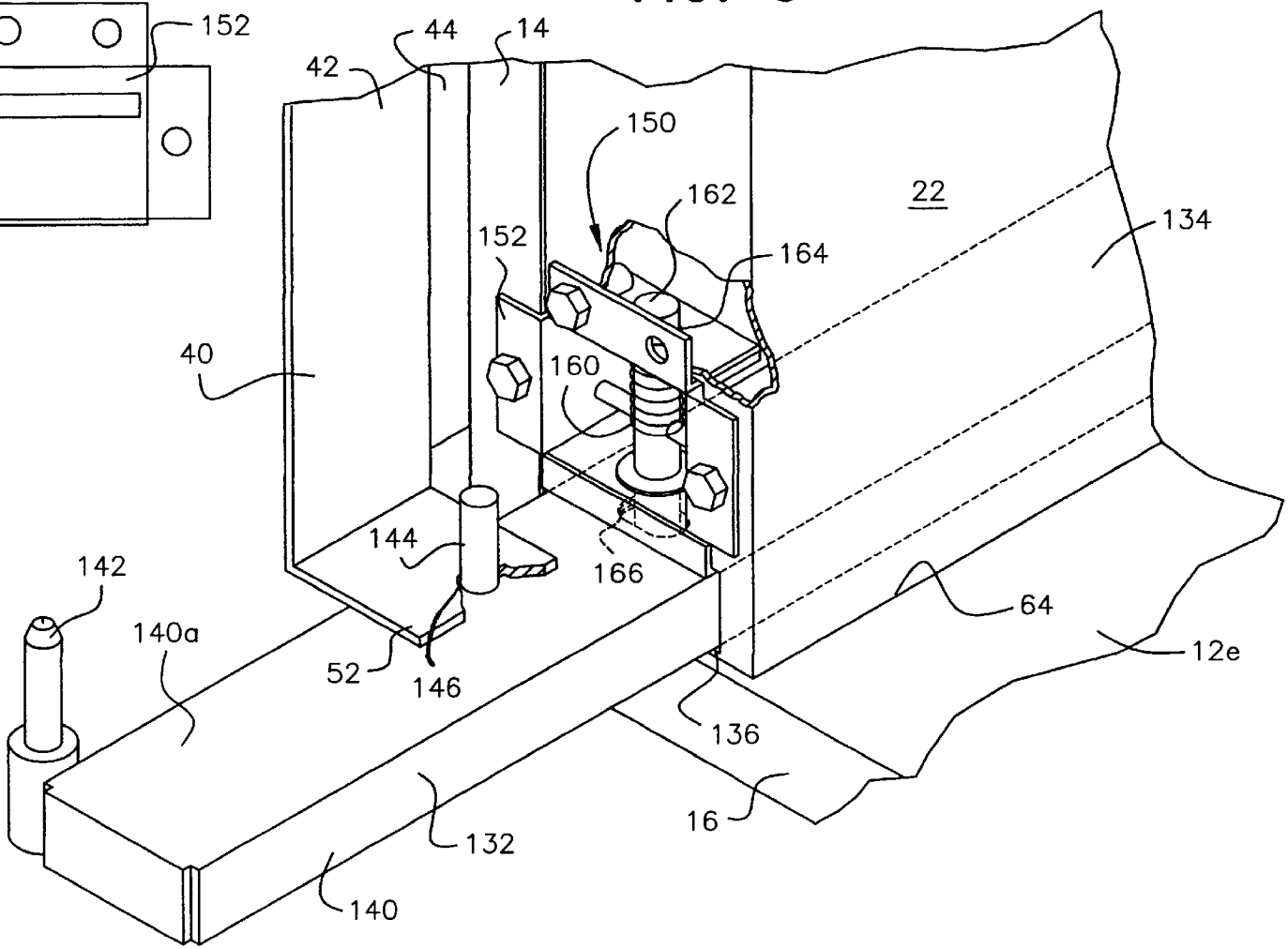
FIG. 5 is an enlarged view of the area designated by the dashed circle denoted FIG. 5 in FIG. 1.
Figure 5A:
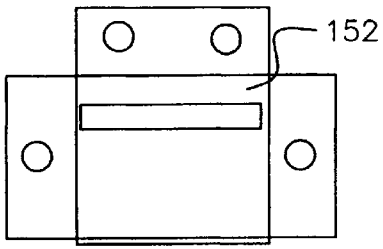
FIG. 5A is a front elevational view of the latch housing shown in FIG. 5.
Figure 6:
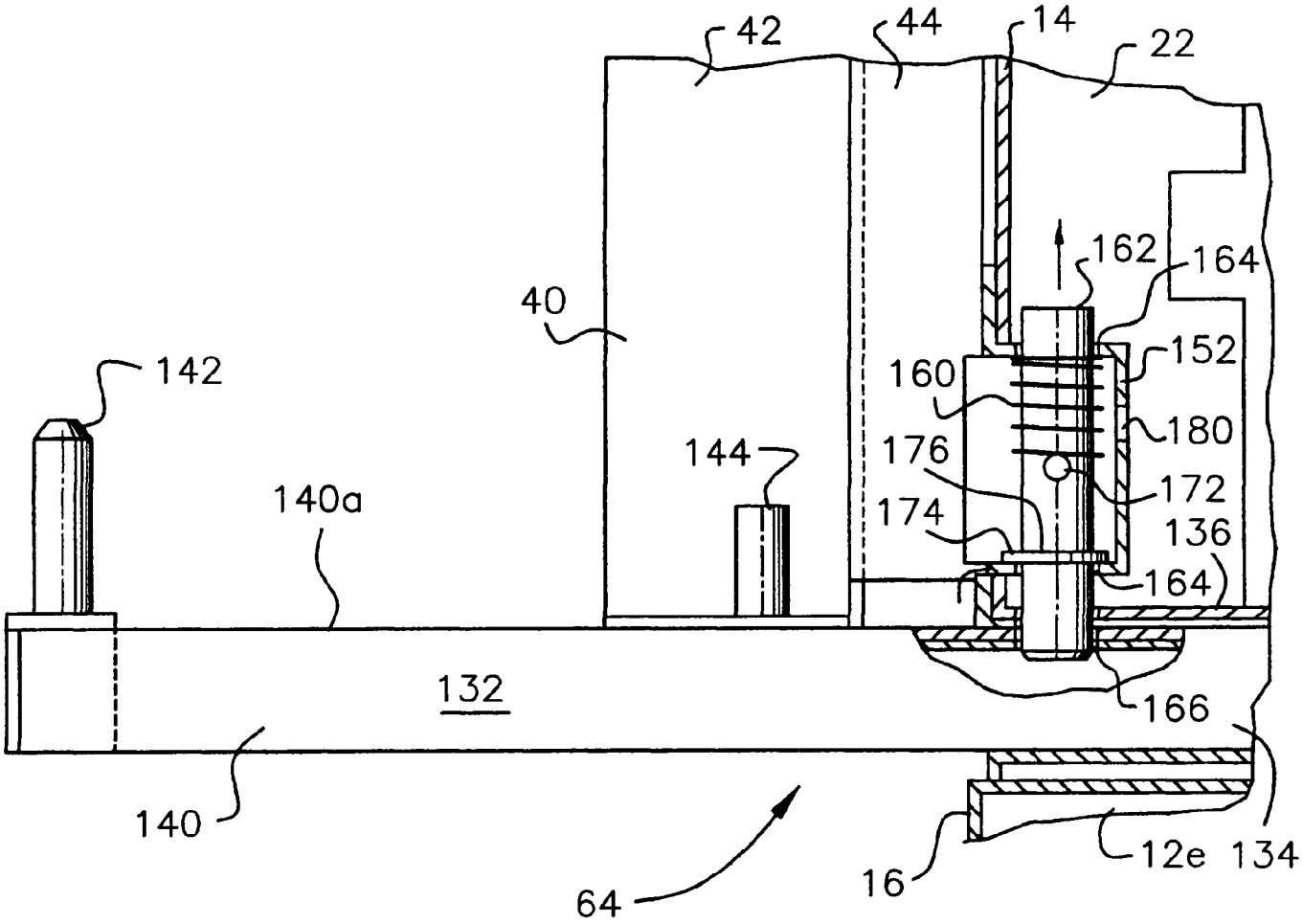
FIG. 6 is a side elevational view of the lower hinge assembly shown in FIG. 5, with the latch pin in the downward position.
Figure 6A:
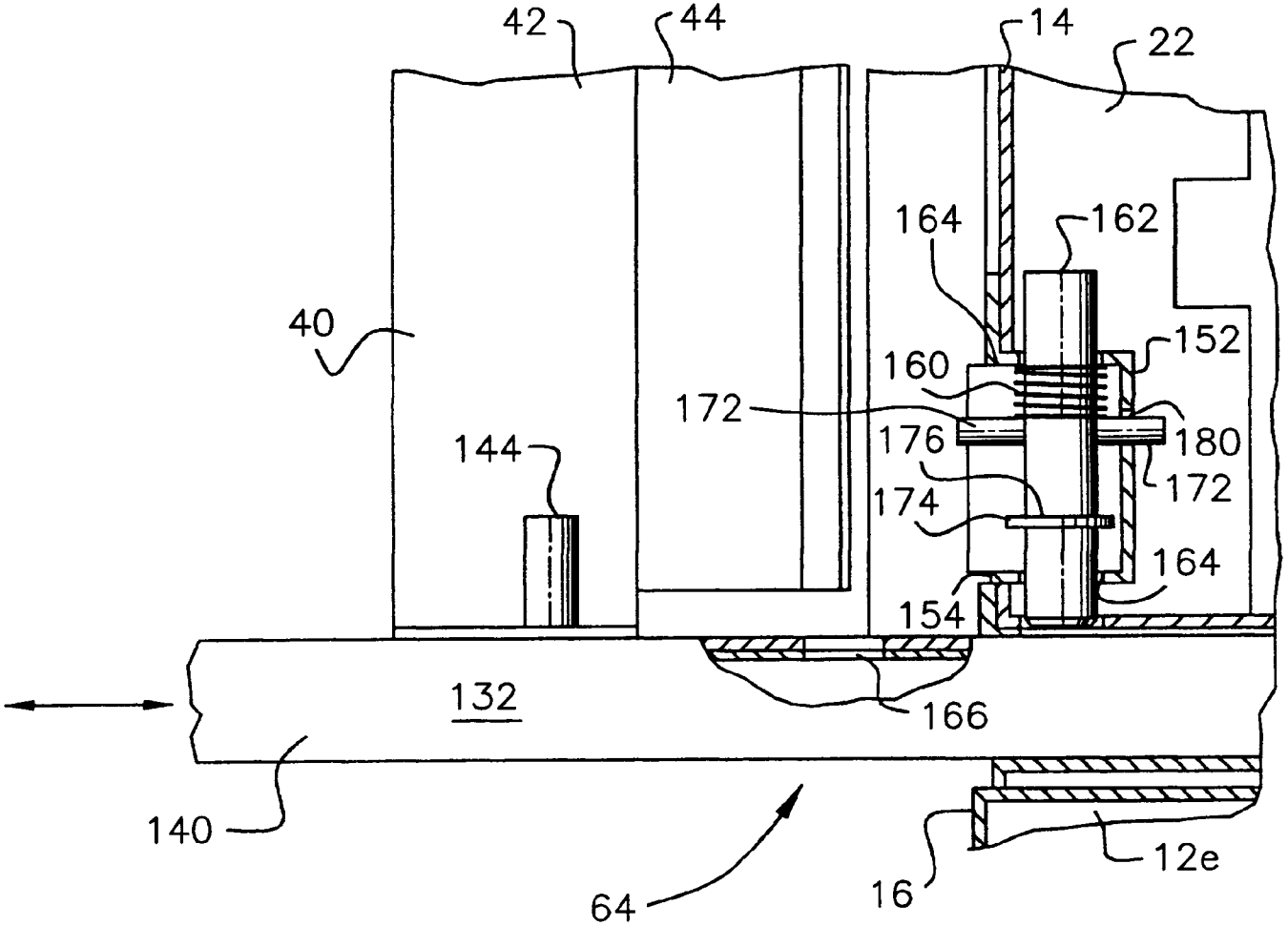
FIG. 6A is a side elevational view similar to FIG. 6, with the latch pin in the upward position.
Figure 7:
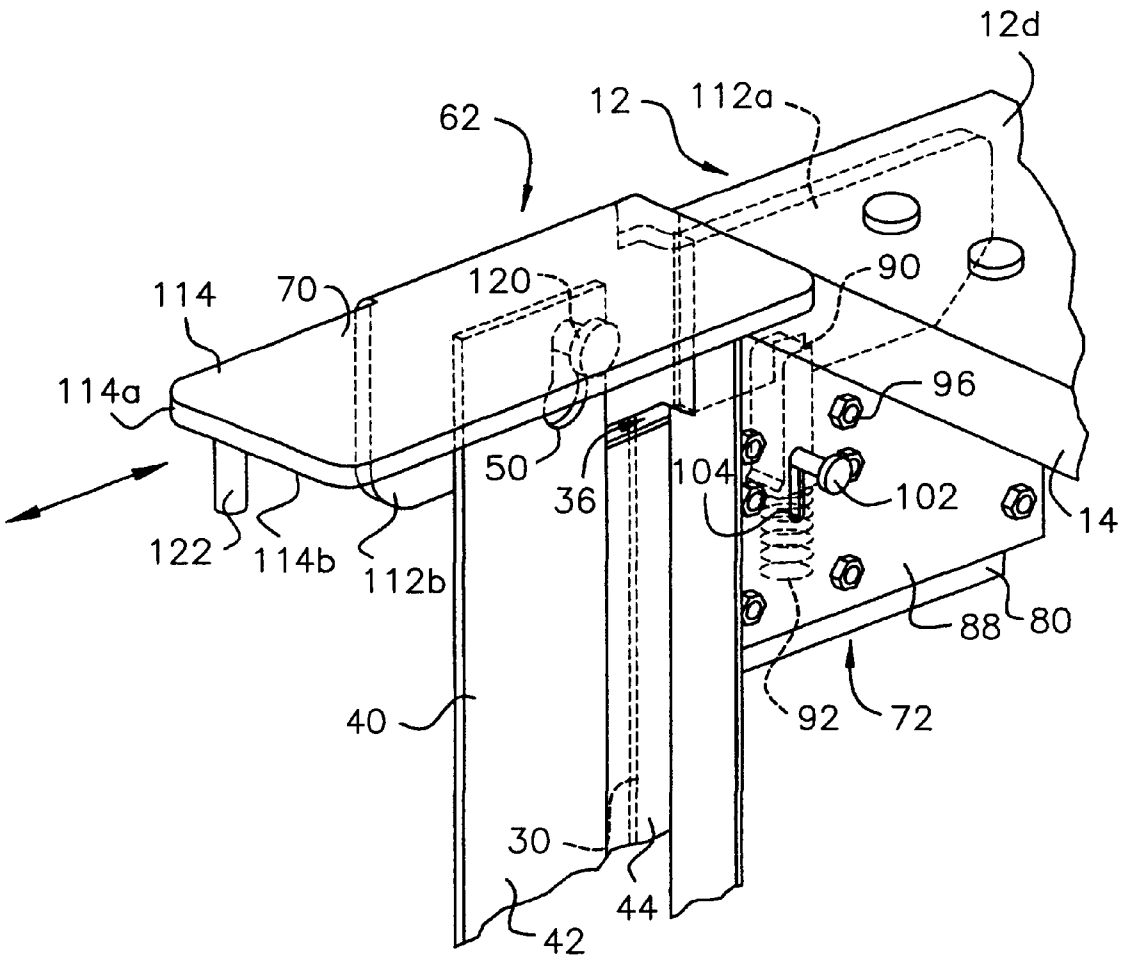
FIG. 7 is an enlarged view of the area designated by the dashed circle denoted FIG. 7 in FIG. 1.
Figure 7A:
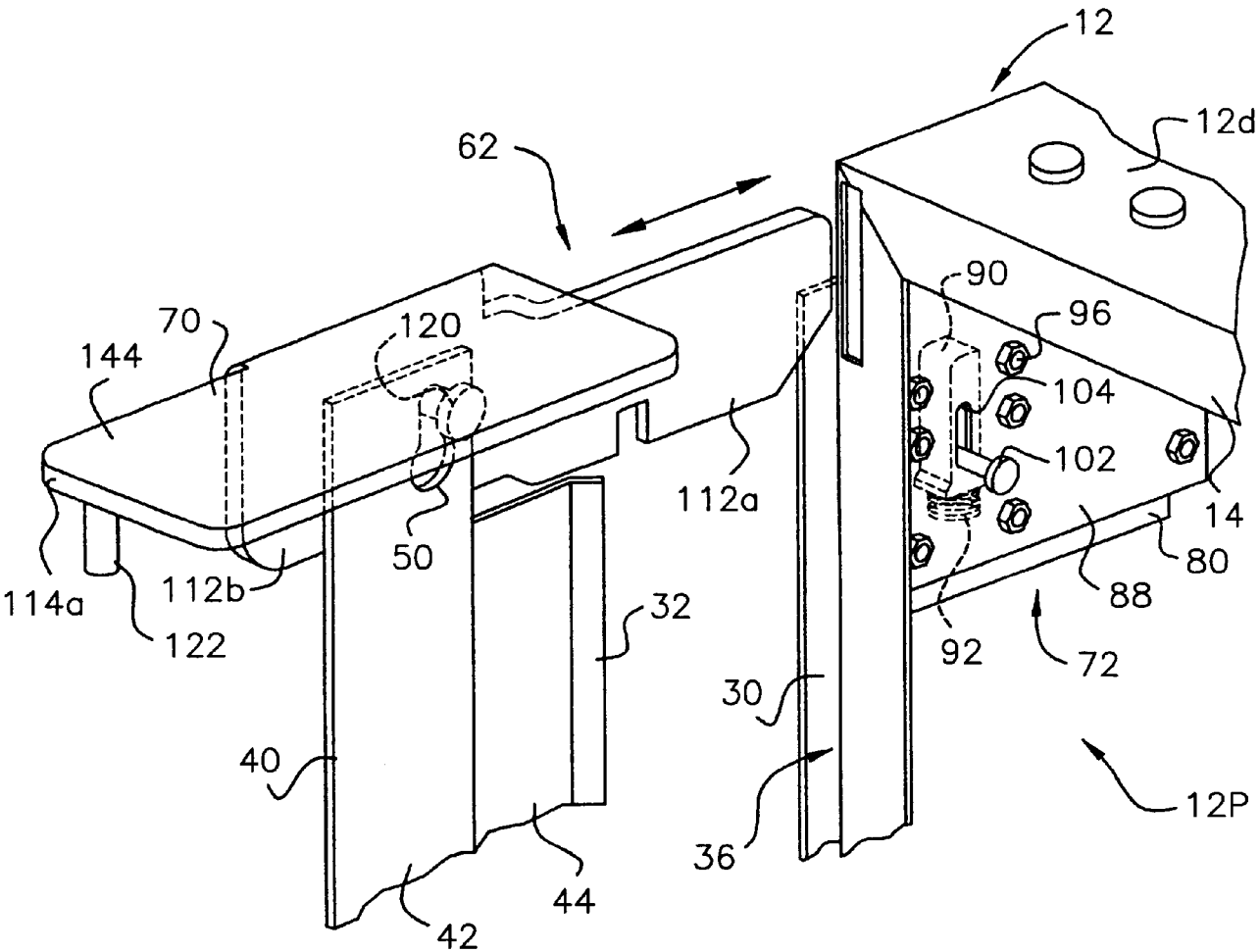
FIG. 7A shows the components of FIG. 7 with the upper hinge assembly disassembled from the cabinet.
Figure 8:
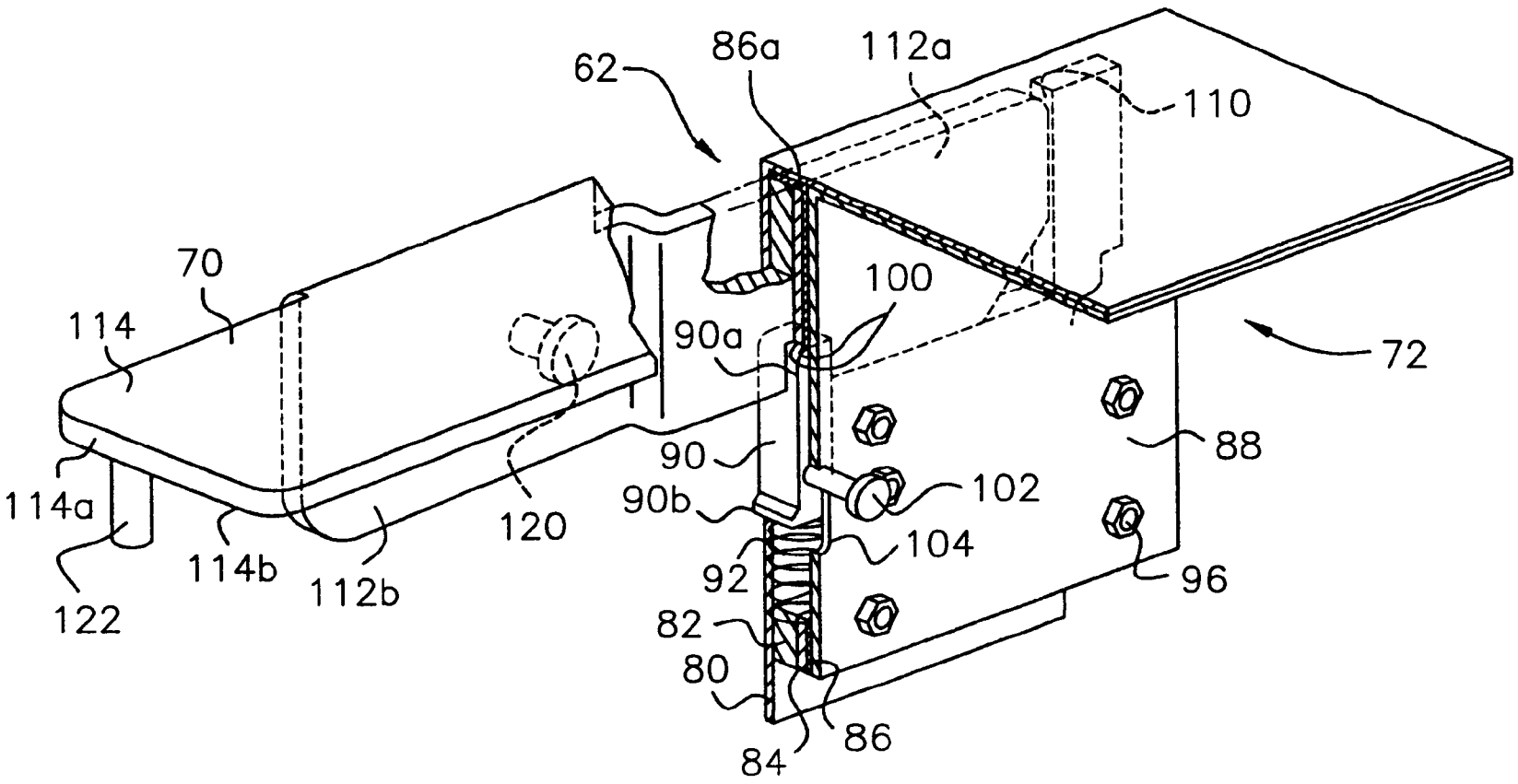
FIG. 8 is a perspective view of the upper hinge assembly of FIG. 7.
Figure 8A:
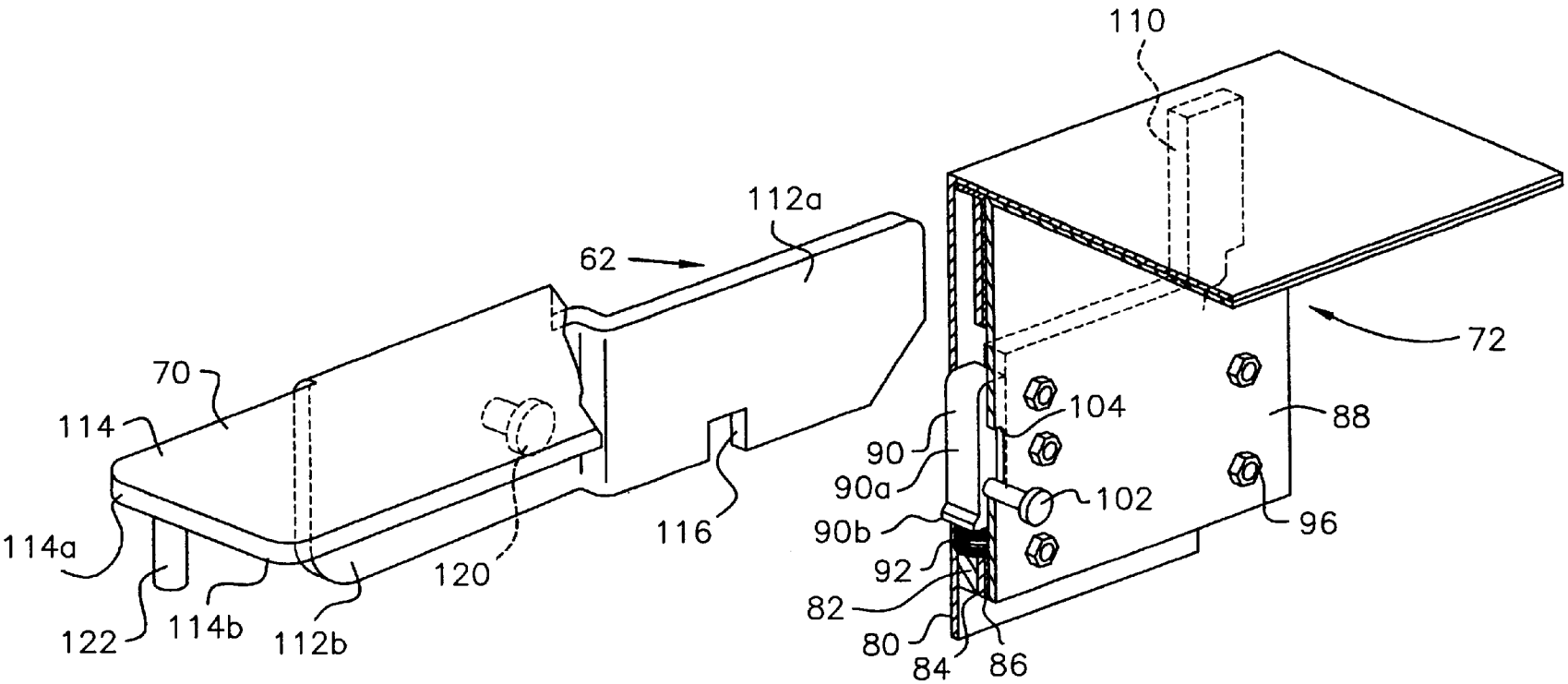
FIG. 8A is a perspective view similar to FIG. 8, with the hinge plate disassembled from the latch mechanism.
Figure 8B:
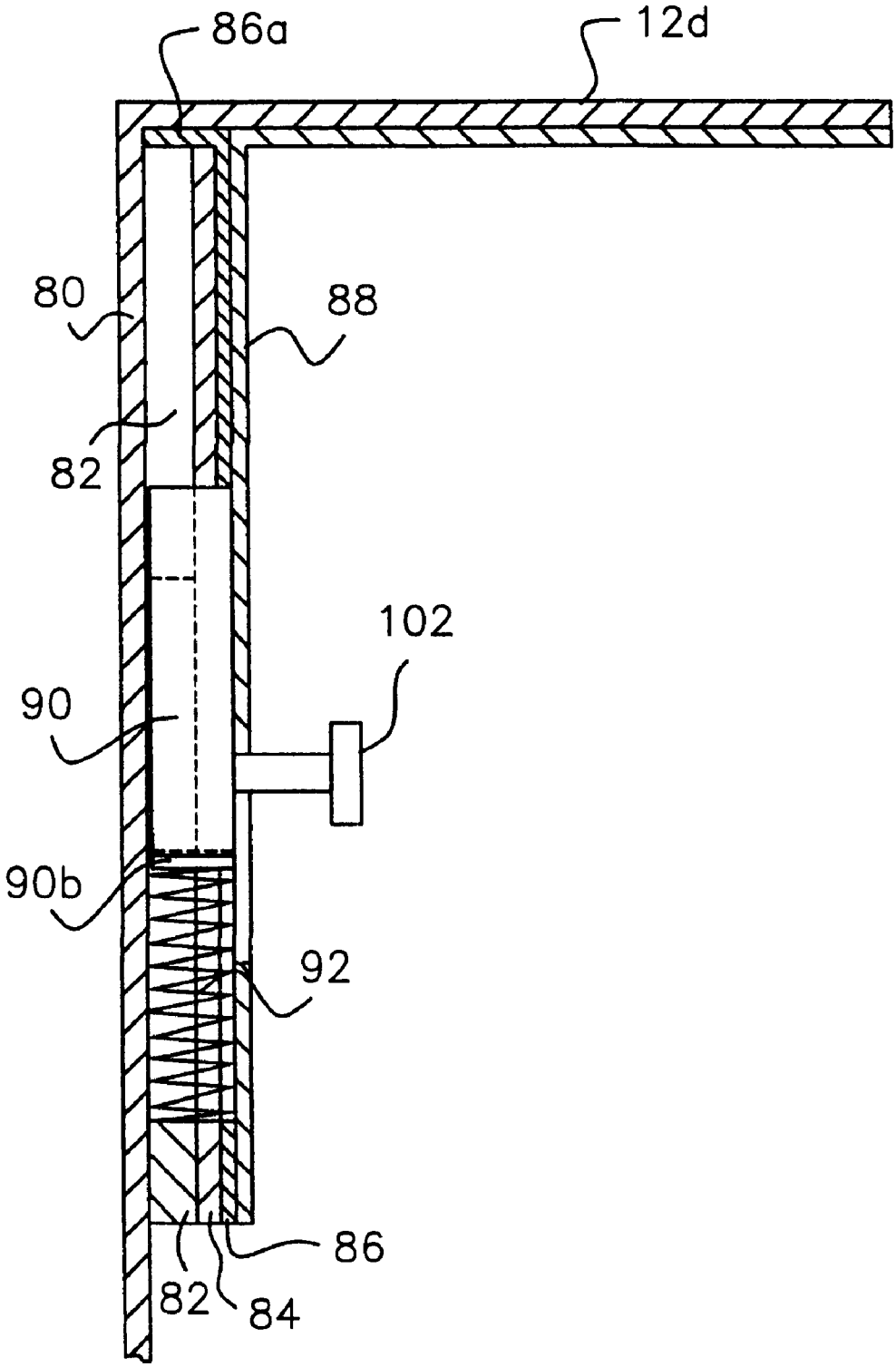
FIG. 8B is a cross-sectional view of the latch mechanism of FIG. 8A, with the plunger in the upward, engaged position.
Figure 8C:
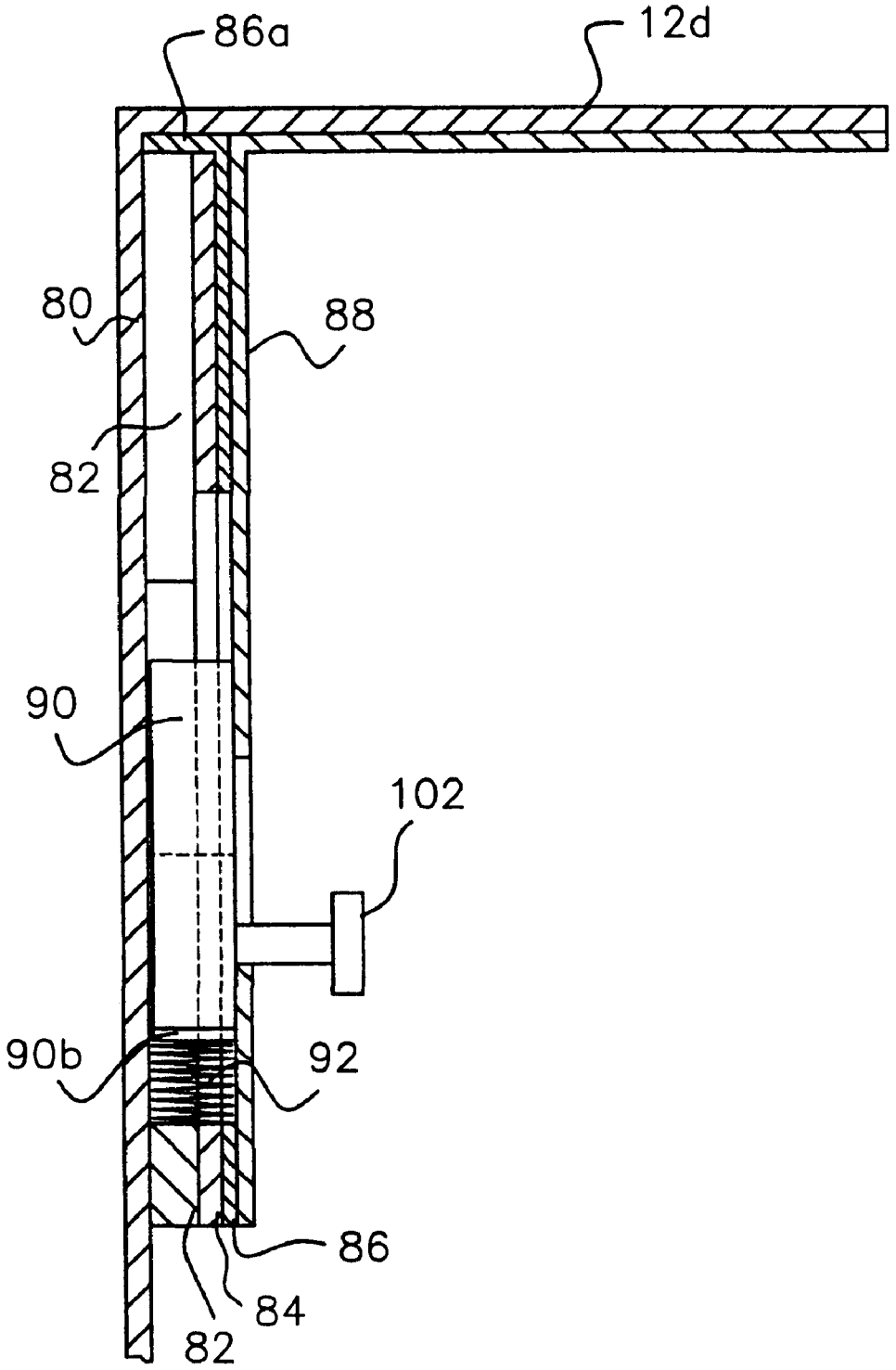
FIG. 8C is a cross-sectional view of the latch mechanism of FIG. 8A, with the plunger in the downward, disengaged position.

Referring to FIGS. 5, 7, and 7A, the vandal panel 40 comprises integral front and back strips 42 and 44. The back strip 44 is complementary in shape to the pocket 36, so as to be selectively insertable into the pocket 36. The front strip 42 is taller than the back strip 44, and has a keyhole 50 formed at the top for a purpose to be described hereinafter. The bottom of the front strip 42 is bent inwardly at a right angle to define a flange 52, also for a purpose to be described hereinafter.

The vending machine 10 is provided with a selectively removable main door 60 that is assembled to the cabinet 12 by upper and lower hinge assemblies 62 and 64. The upper hinge assembly 62 is improved relative to a conventional main door upper hinge assembly in that it omits all conventional fasteners (such as bolts and screws, which may require tools such as a screwdriver or wrench for their installation and removal) previously needed to secure it to the cabinet 12. Omission of the conventional fasteners is achieved by providing the upper hinge assembly 62 in two parts, a hinge plate 70 that is selectively engageable with the main door 60 and a latch mechanism 72 that is installed in the interior of the cabinet 12 at the upper front comer of the right side wall 12*b* and selectively mounts the hinge plate 70 to the cabinet 12. The latch mechanism 72 comprises an inner mounting angle bracket 80 mounted against the interior of the right side wall 12*b*, an inner plunger plate 82 mounted against the inner mounting angle bracket 80, an intermediate plunger plate 84 mounted against the inner plunger plate 82, an outer plunger plate 86 laminated to intermediate plunger plate 84 and having a lip 86c extending over both the intermediate plunger plate 84 and the inner plunger plate 82, an outer mounting angle bracket 88 mounted against the outer mounting plate 84, and a latch plunger 90 and spring 92 housed within the inner and outer mounting plates 82 and 84 and between the inner and outer mounting brackets 80 and 86. The inner and outer mounting brackets 80 and 86 and the inner and outer mounting plates 82 and 84 preferably are made of laminated steel. They are fastened together using press-in threadstuds (not shown), and are mounted to the right side wall 12*b* by fasteners such as bolts 96, or by welding.

The plunger 90 comprises a vertical body portion 90*a* and a shoulder portion 90*b* extending downwardly and outwardly from the bottom of the vertical body portion 90*a*. The inner and outer mounting plates 82 and 84 have apertures 100 formed therein in registration with each other and configured to define a pocket for receiving the plunger 90 with the spring 92 underneath to bias the spring 92 upwardly and limits vertical travel of the plunger 90. A pin 102 is inserted into the body of the plunger 90, oriented to extend into the interior of the cabinet 12, for use as a lever to pull the plunger 90 downwardly against the upward force of the spring 92. An aperture 104 in the outer mounting angle bracket 88 provides clearance to allow for vertical travel of the pin 102. The inner plunger plate 82 also is provided with a notch 110 at the top to define a pocket for receiving a portion of the hinge plate 70, in a manner to be described hereinafter.

The hinge plate 70 comprises an inner vertical portion 112*a*, an outer vertical portion 112*b* integral with the inner vertical portion 112*a*, and a horizontal portion 114 integral with the outer vertical portion 112*b* at the upper edge thereof and extending at a right angle thereto. The inner vertical portion 112*a* is sized for insertion into the pocket defined by the inner plunger plate 82, and the free end 114*a* of the inner vertical portion 112*a* is beveled, preferably at an angle of about 45°, enabling it to depress the plunger 90 as it is inserted into the pocket. The bottom edge 114*b* of the inner vertical portion 112*a* has a notch 116 formed therein, sized and positioned to engage the vertical body portion 90*a* of the plunger 90 when the inner vertical portion 112*a* is fully inserted into the pocket. The plunger 90 is normally biased upwardly by the spring 92 to positively engage the notch 116 until it is pulled downwardly by the pin 102.

A headed pin 120 projects from the inwardly-facing side of the outer vertical portion 112*b* of the hinge plate 70 for engagement with the keyhole 50 in the vandal panel 40. A hinge pin 122 projects downwardly from the horizontal portion 114 of the hinge plate 70, for mounting the main door 60 in a manner to be described hereinafter.

As best shown in FIG. 5, to remove depth in the area of the lower hinge assembly 64, the base plate 16 of the cabinet 12 is made flush with the flange 14 bordering the front face 12*f*, and the lower hinge assembly 64 employs a cantilevered design. In particular, the lower hinge assembly 64 includes a longitudinally-extending, cantilevered hinge base 132 having an internal portion 134 supported within a guide channel 136 formed in the left side panel of the cabinet 12 and an external portion 140 extending outwardly of the guide channel 136. A main door lower hinge pin 142 is affixed to the free end of the external portion 140. The upper face 140*a* of the external portion 140 provides a lower support surface for the flange 52 of the vandal panel 40. Proper positioning of the flange 52 is ensured by a projection 144 on the upper face 140*a* of the external portion 140, which engages an aperture 146 in the flange 52.

The hinge base 132 is removably retained in the cabinet 12 by a latch mechanism 150. The latch mechanism 150 includes a latch housing 152 inserted into an aperture 154 in the right side panel above the guide channel 136, a vertically-oriented coil spring 160 positioned in the housing, and a vertical latch pin 162 inserted in the coil spring 160 and having its upper and lower ends extending through aligned apertures 164 in the top and bottom of the latch housing 152 and a corresponding aperture 166 in the hinge base 132. The latch housing 152 is attached to the left cover panel by fasteners 170 such as four self-tapping screws. A horizontally-oriented dowel 172 is inserted through the latch pin 162 and provides a lower bearing surface for the coil spring 160 to normally bias the latch pin 162 in a downward position. Downward travel of the latch pin 162 is limited by an e-clip 174 inserted into a circumferential groove 176 in the latch pin 162 below the dowel 172.

Should the vending machine 10 be overturned, the downward bias provided by the coil spring 160 will hold the latch pin 162 in position. However, the dowel 172 can be used to lift up the latch pin 162 to release the hinge base 132 from the guide channel 136. Once lifted, the dowel 172 can also be rotated so that one end engages a notch 180 provided in the back of the latch housing 152, to retain the latch pin 162 in the upward position in engagement with the aperture 166 in the hinge base 132.

As in a conventional vending machine, the interior face of the main door 60 of the vending machine 10 in accordance with the invention is provided with an inner door 182. However, to provide ease of handling, and to eliminate some of the bulk resulting from having the inner door 182 attached to the main door 60 during removal of the main door 60, the inner door 182 of the vending machine 10 in accordance with the present invention is selectively removable. To this end, the top of the inner door 182 is hinged to the main door 60 by a conventional fixed pin 184, and the bottom of the inner door 182 is hinged to the main door 60 by a removable hinge pin assembly 190.

The hinge pin assembly 190 comprises a hinge bracket 192 mounted to the inner face of the main door 60, a vertically-oriented coil spring 194 positioned in the housing, and a vertical hinge pin 196 inserted in the coil spring 194 and having its upper and lower ends extending through aligned apertures 200 in the top and bottom of the hinge bracket 192 and in the bottom of the inner door 182. The hinge bracket 192 is attached to the main door 60 by fasteners such as two self-tapping screws 202. A bushing 204 is inserted into an aperture 206 in the inner door 182 to act as a guide for the hinge pin 196. The hinge pin 196 is provided with an operating handle 210 that functions as an upper bearing surface for the coil spring 194 to normally bias the hinge pin 196 in an upward position. The operating handle 210 can be used to depress the hinge pin 196 to release it from the inner door 182. Once depressed, the operating handle 210 can also be rotated so that it engages a notch 212 provided in the side of the hinge bracket 192, to retain the hinge pin 196 in the depressed position.

The vending machine 10 is provided with a door lifter assembly 220 to support the weight of the main door 60 while closed, and to compensate for any door sag that may occur. The door lifter assembly 220 comprises a door lifter 222 and a door lifter bracket 224. The door lifter 222 is mounted on the lower inside corner of the main door 60, on the non-hinged side. The door lifter bracket 224 is inserted into an aperture 226 in the right side panel of the cabinet 12 in a position to receive the door lifter 222 when the main door 60 is closed.

Figure 9:
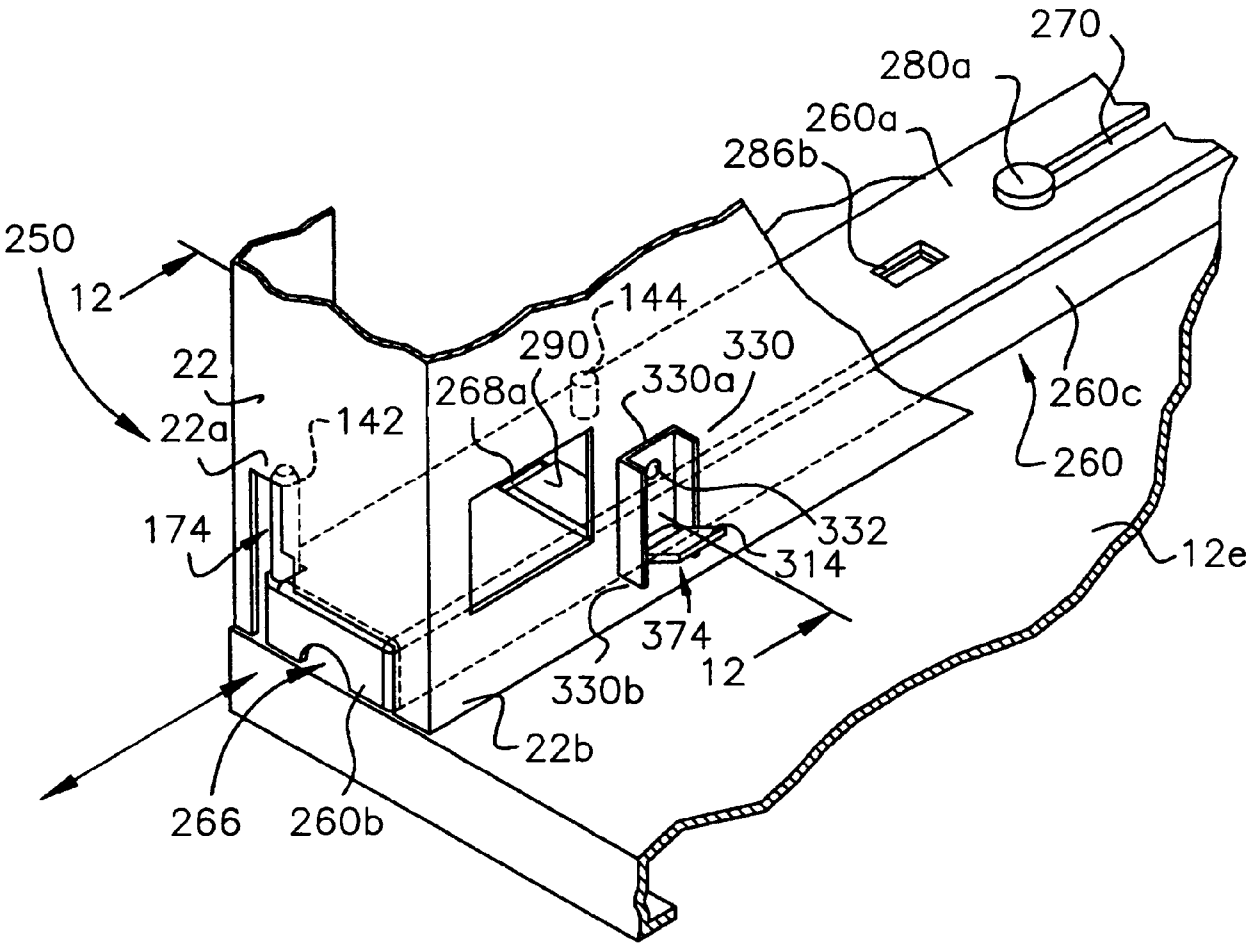
FIG. 9 is a perspective view of an alternative embodiment of the lower hinge assembly, with the bottom hinge plate in a fully retracted position.
Figure 10:
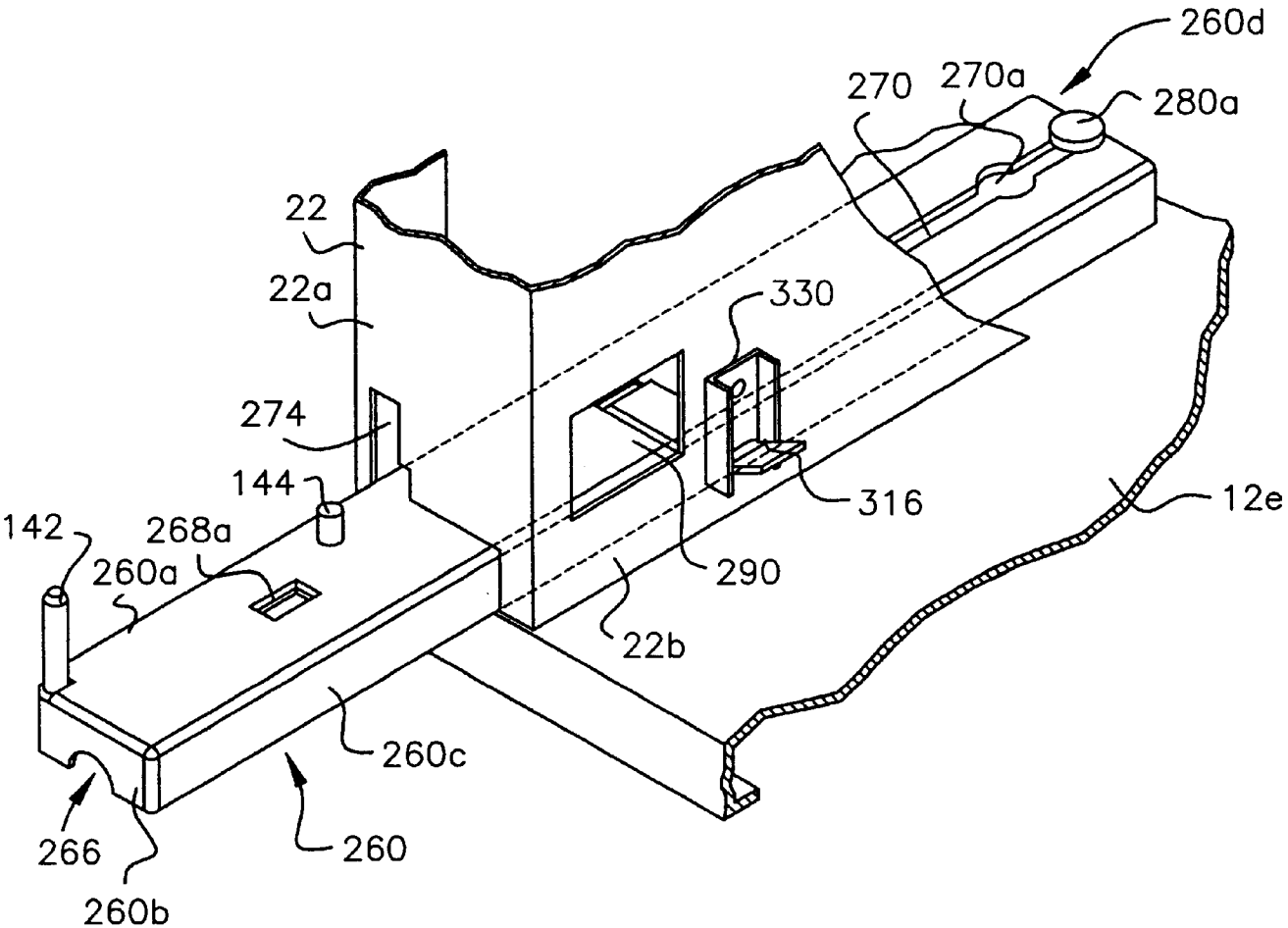
FIG. 10 is a perspective view of the alternative embodiment of the lower hinge assembly, with the bottom hinge plate in a partially extended position.

An alternative embodiment 250 of the lower hinge assembly is illustrated in FIGS. 9–12. The lower hinge assembly 250 includes a bottom hinge plate 260, a rear hinge pin 280 which engages the bottom hinge plate 260, a hinge guide 290 on which the bottom hinge plate 260 rides, and a latch 310 for locking the bottom hinge plate 260 in its extended and retracted positions. FIG. 9 illustrates the lower hinge assembly 250 with the bottom hinge plate 260 in a fully retracted position to reduce the depth of the cabinet 12, and thus the overall depth of the vending machine 10. FIG. 10 illustrates the lower hinge assembly 250 with the bottom hinge plate 260 in a partially extended position, as required for installation of the main door 60 of the vending machine 10. This simplified lever design allows the user either to remove the bottom hinge plate 260 completely from the cabinet 12 or retract the bottom hinge plate 260 into the cabinet 12 to reduce the depth of the vending machine 10, as described below.

The bottom hinge plate 260 is in the form of a hollow rectangular prism, with an upper wall 260*a*, a front wall 260*b*, opposed side walls 260*c*, a rear wall 260*d*, and an open bottom 260*e*. The bottom hinge plate 260 rides on the hinge guide 290, which is received through the open bottom 260*e*.

Figures 11, 12:
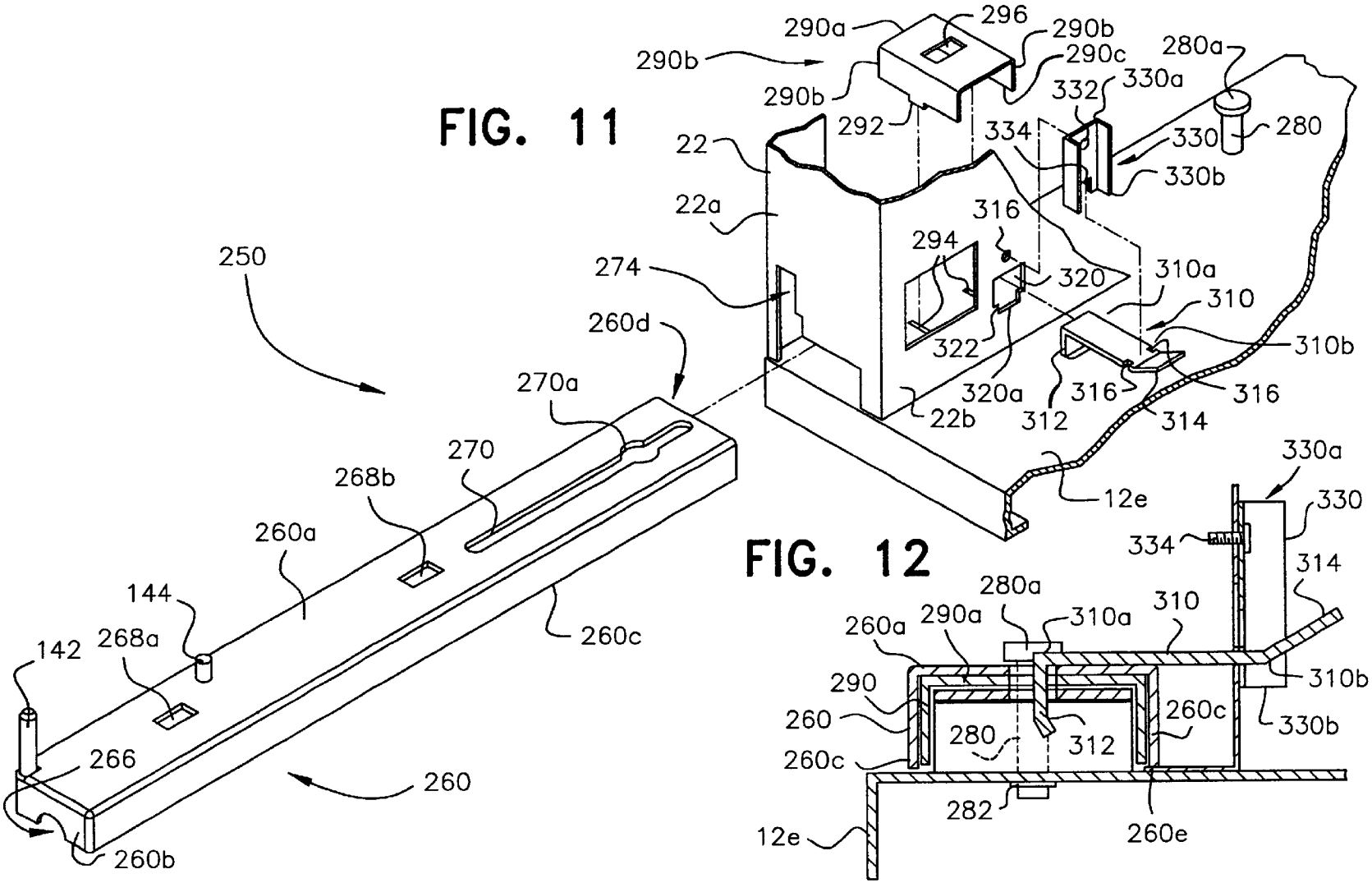
FIG. 11 is an exploded view of the alternative embodiment of the lower hinge assembly shown in FIG. 9.
FIG. 12 is a cross-sectional view of the alternative embodiment of the lower hinge assembly, taken along line 12—12 of FIG. 9.

In this embodiment, the main door lower hinge pin 142 protrudes vertically upwardly through an aperture in the upper wall 260*a* at its outer front comer. The projection 144 extends vertically upwardly from the upper wall 260*a* as in the first embodiment. A notch 266 is provided at the front wall 260*b* of the bottom hinge plate 260. As best shown in FIG. 11, the upper wall 260*a* also has a longitudinal front aperture 268*a*, a longitudinal central aperture 268*b*, and a longitudinal rear slot 270 formed along its lengthwise axis. The front aperture 268*a* is offset from the front wall 260*b*, while the central aperture 268*b* is formed close to or at the center of the lengthwise axis and the rear slot 270 extends between the central aperture 268*b* and the rear wall 260*d* of the bottom hinge plate 260. The rear slot 270 has a clearance hole 270*a* formed therein offset from its rear end.

A notch 274 is provided in the front wall 22*a* of the right panel 22 of the cabinet 12 for receiving the bottom hinge plate 260, and has a profile complementary to that of the bottom hinge plate 260, including the main door lower hinge pin 142 and the projection 144.

A rear hinge pin 280 is attached to the bottom wall 12*e* of the cabinet 12 in line with the longitudinal axis of the bottom hinge plate 260, and extends vertically upwardly from the bottom wall 12*e*. The rear hinge pin 280 has a top head portion 280*a*. The top head portion 280*a* is sized to fit through the clearance hole 270*a* in the slot 270, while the rear hinge pin 280 is sized to slide in the slot 270.

The hinge guide 290 has in transverse cross-section the shape of an inverted U, with an upper wall 290*a*, opposed side walls 290*b* extending vertically downwardly therefrom, and an open bottom 290*c*. The opposed side walls 290*b* are parallel to the back wall 12*c* and the front face 12*f* of the cabinet 12 and have downwardly extending tabs 292 configured to engage with mating notches 294 formed in the bottom wall 12*e*. The upper wall 290*a* also has a longitudinal slot 296 formed therein, for a purpose to be described hereinafter. Preferably, the hinge guide 290 is attached to the bottom wall 12*e* of the cabinet 12 by welding. Alternatively, the hinge guide 290 can be connected to the bottom wall 12*e* using fasteners or any other suitable means.

The latch 310 has inner and outer ends 310*a* and 310*b*, with a lip 312 extending downwardly from the inner end 310*a* and a tab 314 extending upwardly from the outer end 310*b*. The lip 312 is generally vertical, and configured to engage the longitudinal front and central apertures 268*a* and 268*b* of the bottom hinge plate 260, while the tab 314 extends at an angle to the horizontal. A pair of opposed notches 316 are formed in the latch 310 inwardly of the tab 314. An aperture 320 is formed in the right panel 22 of the cabinet 12 for receiving the inner end 310*a* of the latch 310. The aperture 320 is generally rectangular, but necked in at the bottom to define shoulders 322 which engage the notches 316 of the latch 310. The tab 314 extends outwardly from the aperture 320.

The bottom hinge assembly 250 is assembled as follows. The tabs 292 of the opposed side walls 290*b* of the hinge guide 290 are inserted into the slots 294 in the bottom wall 12*e* of the cabinet 12. The bottom hinge plate 260 is inserted into the notch 274 rear end 260*d* first. When the bottom hinge plate 260 comes into contact with the hinge guide 290, the front wall 260*b* of the bottom hinge guide 290 is rotated downwardly so that the rear wall 260*d* can clear the hinge guide 290 and the rear hinge pin 280. The bottom hinge plate 260 drops down into position when the clearance hole 270*a* in the rear slot 270 of the bottom hinge plate 260 engages the top head portion 280*a* of the rear hinge pin 280. The notch 266 in front wall 260*b* of the bottom hinge plate 260 provides a finger hold for removing the bottom hinge plate 260 when it is fully inserted into the notch 274 of the right panel 22 of the cabinet 12.

The rear hinge pin 280 supports the weight of the main door 60 and acts as a guide for inserting the bottom hinge plate 260 into the notch 274. The top head portion 280*a* of the rear hinge pin 280 limits movement of the bottom hinge plate 260 when engaged with the clearance hole 270*a* of rear slot 270 of the bottom hinge plate 260. The rear hinge pin 280 can be attached to the bottom wall 12*e* of the cabinet 12 by welding, by providing a hole in the base plate 130 (not shown) and threads on hinge pin 280 configured to engage a nut 282 underneath the bottom wall 12*e* when the hinge pin 280 is inserted through the hole in the bottom wall 12*e*, or by any other suitable means.

When the bottom hinge plate 260 is positioned in the fully retracted position (FIG. 9), its front aperture 268*a* is in registration with the longitudinal slot 296 in the upper wall 290*a* of the hinge guide 290. Conversely, when the bottom hinge plate 260 is in the extended position (FIG. 10), its central aperture 268*b* is in registration with the longitudinal slot 296. In both cases, the lip 312 of the latch 310 will pass through the aligned slots and provide a positive engagement for the bottom hinge plate 260 to prevent it from "walking."

The latch 310 is secured in place by a latch retainer 330 positioned against the side surface 22*b* of the right panel 22 of the cabinet 12. The latch retainer 330 includes top and bottom ends 330*a* and 330*b*, an opening 332 formed in the top end 330*a*, and a notch 334 formed in the bottom end 330*b* and configured to receive the latch 310. The latch retainer 330 is placed against the side surface 22*b* so that the notch 334 engages the latch 310. A fastener 336, such as a tapping screw, is inserted through the opening 326 located above the aperture 320 in the side surface 22*b*.

The bottom edge 320*a* of the aperture 320 acts as a hinge point, allowing the latch 310 to pivot upwardly and downwardly against the bottom edge 320*a*. If the vending machine 10 were overturned and the latch 310 became disengaged, the rear hinge pin 280 would prevent the bottom hinge plate 260 from being pulled out of the vending machine 10, and thus would prevent access to the inside of the vending machine 10.

It will be appreciated from the above-described structure that the main door 60 can easily be removed from the cabinet 12 by releasing the upper and lower hinge assemblies 62 and 64 or the lower hinge assembly 250. In the upper hinge assembly 62, the pin 102 is used to pull down the plunger 90, thus disengaging the hinge plate 70 from the latch mechanism 72 at the top of the cabinet 12. In the lower hinge assembly 64, the dowel 172 is used to pull up the latch pin 162, thus disengaging the hinge base 132 from the bottom of the cabinet 12. Similarly, the inner door 182 can be removed from the main door 60 by lifting up the operating handle 210, thus disengaging the hinge pin 196 of the hinge assembly from the inner door 182.

According to the alternative embodiment of the lower hinge assembly 250, the bottom hinge plate 260 can be locked in a partially or fully retracted position by raising the latch 310 and sliding the bottom hinge plate 260.

The vandal panel 40 can be installed or removed while the main door 60 is in the open position only, by engaging or disengaging the keyhole 50 of the vandal panel 40 from the pin of the upper hinge assembly hinge plate, and by engaging or disengaging the aperture 146 in the flange 52 from the projection 144 on the hinge base 132 of the lower hinge assembly 64. Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A vending machine comprising:

a cabinet having a hinged side and a non-hinged side;

a main door having a hinged side, a non-hinged side, and an interior face, said main door being movable between an open position and a closed position;

main door hinging means for hinging said hinged side of said main door to said hinged side of said cabinet and for selectively removing said main door from said cabinet without the use of tools or the removal of fasteners;

an inner door over said interior face of said main door, said inner door having a hinged side and a non-hinged side;

inner door hinging means for hinging said hinged side of said inner door to said interior face of said main door and for selectively removing said inner door from said main door without the use of tools or the removal of fasteners; and a vandal panel positioned to cover the facing edges of the hinged sides of said main door and said cabinet when said main door is in said closed position, said vandal panel being selectively removable without the use of tools or the removal of fasteners.

2. The vending machine of claim 1, wherein said main door hinging means comprises upper and lower hinge assemblies hinging said main door to hinged side of said cabinet, at least one of said upper and lower hinge assemblies including a portion that is selectively removable from said cabinet without the use of tools or the removal of fasteners.

3. The vending machine of claim 2, wherein both of said upper and lower hinge assemblies include a portion that is selectively removable from said cabinet.

4. The vending machine of claim 2, wherein said upper hinge assembly includes a hinge plate having a first end to which said main door is hinged and a second end selectively attached to said hinged side of said cabinet and removable from said cabinet without the use of tools or the removal of fasteners.

5. The vending machine of claim 4, wherein said upper hinge assembly further includes a latch mechanism mounted on said hinged side of said cabinet selectively attaching said second end of said hinge plate to said hinged side of said cabinet, said latch mechanism being configured to release said hinge plate from said hinged side of said cabinet without the use of tools or the removal of fasteners.

6. The vending machine of claim 5, wherein said lower hinge assembly includes a hinge base having a first end to which said main door is hinged and a second end selectively attached to said cabinet and removable from said cabinet without the use of tools or the removal of fasteners.

7. The vending machine of claim 6, wherein said lower hinge assembly further includes includes a latch mounted on said hinged side of said cabinet selectively attaching said second end of said hinge base to said hinged side of said cabinet, said latch being configured to release said hinge base from said hinged side of said cabinet without the use of tools or the removal of fasteners.

8. The vending machine of claim 6, wherein said hinge base is at least partially retractable into said cabinet.

9. The vending machine of claim 2, wherein said lower hinge assembly includes a hinge base having a first end to which said main door is hinged and a second end selectively attached to said cabinet and removable from said cabinet without the use of tools or the removal of fasteners.

10. The vending machine of claim 9, wherein said lower hinge assembly further includes a latch mechanism mounted on said hinged side of said cabinet selectively attaching said second end of said hinge base to said hinged side of said cabinet, said latch mechanism being configured to release said hinge base from said hinged side of said cabinet without the use of tools or the removal of fasteners.

11. The vending machine of claim 2, wherein said vandal panel has upper and lower ends engaging said upper and lower hinge assemblies, respectively, and being removable therefrom without the use of tools or the removal of fasteners.

12. The vending machine of claim 2, further comprising door lifter means for supporting the weight of said main door while said main door is in said closed position, and for compensating for any sagging of said main door that may occur.

13. The vending machine of claim 12, wherein said door lifter means comprises a door lifter extending outwardly from said interior face of said main door and a door lifter bracket positioned in said cabinet to receive said door lifter when said main door is in said closed position.

14. The vending machine of claim 13, wherein said lower hinge assembly comprises:

a hinge base having a first end to which said main door is hinged and a second end selectively attached to said cabinet and removable from said cabinet without the use of tools or the removal of fasteners; and a latch mechanism mounted on said hinged side of said cabinet selectively attaching said second end of said hinge base to said hinged side of said cabinet, said latch mechanism being configured to release said hinge base from said hinged side of said cabinet without the use of tools or the removal of fasteners.

15. A vending machine comprising:

a cabinet having a hinged side and a non-hinged side;

a main door having a top, a bottom, and an interior face;

a hinge plate hinging said top of said main door to said hinged side of said cabinet, said hinge plate having a first end and a second end;

a latch mechanism mounted on said hinged side of said cabinet selectively attaching said second end of said hinge plate to said hinged side of said cabinet, said latch mechanism being configured to release said hinge plate from said hinged side of said cabinet without the use of tools or the removal of fasteners;

a lower hinge assembly hinging said bottom of said main door to said hinged side of said cabinet;

an inner door over said interior face of said main door, said inner door having a hinged side and a non-hinged side;

inner door hinging means for hinging said hinged side of said interior face of said main door along one side thereof and for selectively removing said inner door from said main door without the use of tools or the removal of fasteners; and a vandal panel positioned to cover the facing edges of the hinged sides of said main door and said cabinet when said main door is in said closed position, said vandal panel being selectively removable without the use of tools or the removal of fasteners.

16. The vending machine of claim 15, wherein said vandal panel has upper and lower ends engaging said hinge plate and said lower hinge assembly, respectively, and being removable therefrom without the use of tools or the removal of fasteners.

17. The vending machine of claim 16, further comprising door lifter means for supporting the weight of said main door while said main door is in said closed position, and for compensating for any sagging of said main door that may occur.

18. The vending machine of claim 17, wherein said door lifter means comprises a door lifter extending outwardly from said interior face of said main door and a door lifter bracket positioned in said cabinet to receive said door lifter when said main door is in said closed position.

19. A vending machine comprising:

a cabinet having a hinged side and a non-hinged side;

a main door having a top and a bottom;

an upper hinge assembly hinging said top of said main door to said hinged side of said cabinet;

a hinge base having a first end to which said main door is hinged and a second end selectively attached to said cabinet and removable from said cabinet without the use of tools or the removal of fasteners; and a latch mechanism mounted on said hinged side of said cabinet selectively attaching said second end of said hinge base to said hinged side of said cabinet, said latch mechanism being configured to release said hinge base from said hinged side of said cabinet without the use of tools or the removal of fasteners.

20. The vending machine of claim 19, further comprising:

an inner door over an inner face of said main door, said inner door having a hinged side and a non-hinged side;

inner door hinging means for hinging said hinged side of an interior face of said main door along one side thereof and for selectively removing said inner door from said main door without the use of tools or the removal of fasteners; and a vandal panel positioned to cover the facing edges of the hinged sides of said main door and said cabinet when said main door is in said closed position, said vandal panel being selectively removable without the use of tools or the removal of fasteners.

21. The vending machine of claim 20, wherein said vandal panel has upper and lower ends engaging said upper hinge assembly and said hinge base, respectively, and being removable therefrom without the use of tools or the removal of fasteners.

22. The vending machine of claim 19, further comprising door lifter means for supporting the weight of said main door while said main door is in said closed position, and for compensating for any sagging of said main door that may occur.

23. The vending machine of claim 22, wherein said door lifter means comprises a door lifter extending outwardly from said interior face of said main door and a door lifter bracket positioned in said cabinet to receive said door lifter when said main door is in said closed position.

* * * * *